US005427904A

United States Patent [19]

Borst et al.

[11] Patent Number: 5,427,904

[45] Date of Patent: Jun. 27, 1995

[54] PROCESS FOR THE PREPARATION OF SILVER HALIDE EMULSIONS

[75] Inventors: Hans-Ulrich Borst, Elsdorf; Lothar Endres; Hans Öhlschläger, both of Bergisch Gladbach, all of Germany

[73] Assignee: Agfa-Gevaert AG, Leverkusen, Germany

[21] Appl. No.: 125,737

[22] Filed: Sep. 24, 1993

[30] Foreign Application Priority Data

Oct. 7, 1992 [DE] Germany ..... 42 33 714.3

[51] Int. Cl.[6] ..... G03C 1/005; G03C 1/015; G03C 1/035

[52] U.S. Cl. ..... 430/569; 430/600; 430/613; 430/614

[58] Field of Search ..... 430/569, 600, 613, 614

[56] References Cited

U.S. PATENT DOCUMENTS

| | | | |
|---|---|---|---|
| 2,146,938 | 2/1939 | Claus . | |
| 3,206,313 | 9/1965 | Porter et al. . | |
| 3,317,322 | 5/1967 | Porter et al. . | |
| 4,298,683 | 11/1981 | Becker et al. | 430/569 |
| 4,379,837 | 4/1983 | Lapp et al. | 430/434 |
| 5,273,871 | 12/1993 | Takada et al. | 430/569 |

FOREIGN PATENT DOCUMENTS

| | | |
|---|---|---|
| 0006543 | 1/1980 | European Pat. Off. . |
| 0421740 | 4/1991 | European Pat. Off. . |
| 1207791 | 12/1965 | Germany . |

OTHER PUBLICATIONS

Report by D. Markocki and W. Romer in "Korpuskular Photographie", IV (1963), p. 149 et seq.

"Zhurnal Nauchnoi Prikladnoi Fotografi Kinematografi 5", No. 2 (1960), pp. 81–83 (translation).

*Primary Examiner*—Charles L. Bowers, Jr.
*Assistant Examiner*—Mark F. Huff
*Attorney, Agent, or Firm*—Connolly and Hutz

[57] ABSTRACT

Emulsions having an improved sensitivity/grain ratio are obtained when a silver halide emulsion containing up to 20 mol % of AgI is prepared by the precipitation of a silver halide emulsion A containing up to 100 mol % of AgI and the addition of a silver halide emulsion B which contains up to 40 mol % of AgI, has an average grain size of at most 0.25 μm and is always more soluble in aqueous gelatine solution than emulsion A either due to its grain size or due to its iodide content, this being carried out in the presence of at least two compounds selected from imidazole, histidine (α-amino-β-imidazolyl-(5)-propionic acid) and other monocyclic, 5- or 6-membered heterocyclic compounds which have at least one ring nitrogen atom, are free from SH groups and form sparingly soluble silver salts in weak acid to neutral aqueous solutions, which salts redissolve at pH>9 when ammonia is added, one of the at least two compounds being imidazole or histidine and at least one other compound being a compound other than imidazole or histidine.

20 Claims, No Drawings

PROCESS FOR THE PREPARATION OF SILVER HALIDE EMULSIONS

This invention relates to a process for the preparation of silver halide emulsions in which emulsions differing in their solubility are mixed and subjected to Ostwald ripening.

Silver halide emulsions are generally prepared by the precipitation of silver halide in a binder, which is preferably gelatine. This precipitation of the silver halide may be carried out by adding an aqueous solution of a silver salt to a gelatine-containing halide solution. The size of the silver halide grains obtained is controlled inter alia by the temperature of the solution, the inflow time and the excess of halide.

The grain size and grain size distribution of the silver halide grains of the emulsions obtained are also determined primarily by so-called Ostwald ripening. By "Ostwald ripening" is meant the dissolving of more readily soluble silver halide grains by the action of silver halide solvents followed by deposition of the dissolved silver halide on less soluble silver halide grains.

It is also known to inject the aqueous solutions of a silver salt and of a halide simultaneously into a receiver (double jet process).

Other processes for the preparation of silver halide emulsions are also known, in which emulsions of differing grain sizes are mixed together and subjected to Ostwald ripening in the presence of silver halide solvents. One precondition for such procedures is that the silver halide crystals used for this purpose differ in their solubilities. Differences in solubility can be obtained by using differing grain sizes and/or differing halide compositions. Such processes are known from U.S. Pat. Nos. 2 146 983, 3 206 313 and 3 317 322, German Auslegeschrift 1 207 791, the Report by D. Markocki and W. Romer in "Korpuskular Photographie", IV (1963), pages 149 et seq, from "Zhurnal Nauchnoi Prikladnoi Fotografi Kinematografi 5, NO. 2 (1960), pages 81–83, and from EP-PS 42 060.

The more readily soluble silver halide emulsion used in these processes is preferably a fine grained silver halide: emulsion having an average grain diameter smaller than that of the more sparingly soluble silver halide emulsion.

The advantages of the processes mentioned above lie inter alia in the controlled Ostwald ripening and especially in the avoidance of localized silver ion supersaturations.

The following are examples of known silver halide solvents: Halides, especially alkali metal and ammonium halides, in particular bromides and chlorides; ammonia; thiocyanates, in particular alkali metal and ammonium thiocyanates; sulphites, in particular alkali metal and ammonium sulphites; thiosulphate; organic amines; thioethers and imidazole derivatives. Suitable thioethers are described, for example, in U.S. Pat. Nos. 2, 271 157, 3 507 657, 3 531 289 and 3 574 628. Particularly suitable thioethers are also described in German Offenlegungsschrifien 2 614 862 and 2 824 249. Suitable imidazole derivatives are described in German Offenlegungsschrift 27 58 711.

Both highly sensitive and fine grained silver halide emulsions can be prepared by the processes mentioned above but it has not hitherto been possible to obtain both properties together to a sufficient degree.

It is therefore an object of the present invention to provide a process for the preparation of highly sensitive, fine grained silver halide emulsions which have a low fog value.

This problem is solved[by an improved process of Ostwald ripening.

The invention therefore relates to a process for the preparation of a silver halide emulsion containing up to 20 mol-% of AgI by the precipitation of a silver halide emulsion A containing up to 100 mol-% of AgI and the addition of a silver halide emulsion B which contains up to 40 mol-% of AgI, has an average grain size of at most 0.25 μm and is always more soluble in aqueous gelatine solution than emulsion A either due to its grain size or due to its iodide content, this beings, carried out in the presence of at least two compounds selected from imidazole, histidine (α-amino-β-imidazolyl-(5)-propionic acid) and other monocyclic 5-membered or 6-membered heterocyclic compounds which have at least one ring nitrogen atom and are free from SH groups and form sparingly soluble silver saks in weak acid to neutral aqueous solutions, which salts redissolve at pH>9 when ammonia is added, one of the at least two compounds being imidazole or histidine and at least one other compound being a compound other than imidazole or histidine.

Monocyclic compounds are understood to be compounds which do not contain any condensed rings in the whole molecule. The grain size is taken to be the diameter of a sphere of equal volume.

The iodide content of emulsion A is preferably from 10 to 90 mol-%.

The following, for example, are suitable: Imidazoles, oxazoles, thiazoles, triazoles, thiadiazoles, oxadiazoles, pyridines, tetrazoles and pyrimidines which may be substituted by alkyl preferably having up to 4 carbon atoms, such as methyl, ethyl or isopropyl; by alkenyl such as allyl; by aryl such as phenyl or halogen such as chlorine or bromine or carboxylic acid groups or derivatives thereof such as carbalkoxy or carbonamido; by sulphonic acid groups, sulphonamide, sulphones or thioethers such as methylthio or carboxyalkylthio; or by substituted or unsubstituted amino groups.

The Ostwald ripening is preferably carried out at an $E_{Ag}$-value of from −20 to −120 mV, in particular from −40 to −100 mV, at a pH of from 4 to 10, in particular from 6 to 8, and at a temperature of from 40 to 90° C., in particular from 50 to 75° C. The process is normally completed after 20 minutes under these conditions. ($E_{Ag}$ is the potential of a silver electrode vs. saturated Kalomelelectrode).

The gelatine/silver halide ratio by weight expressed in terms of the quantity of silver nitrate used is preferably from 0.05 to 1.0 in this process of Ostwald ripening, in particular from 0.1 to 0.5.

Emulsions A and B are preferably mixed together in a ratio by weight of from 1:1 to 1:20, preferably from 1:2 to 1:10, expressed in terms of the quantity of silver nitrate put into the process. Emulsions A and B are mainly silver iodobromide emulsions; they may also contain small proportions of silver chloride. The grain size of Emulsion A ranges in particular from 0.1 to 1.5 μm and that of Emulsion B from 0.01 to 0.2 μm.

If the iodide content of Emulsion A is from 40 to 90 mol-%, the emulsion consists predominantly of grains containing about 40 mol-% of AgI and pure AgI grains.

The iodide content of Emulsion A can be adjusted by suitable choice of the mixture of soluble halides used for precipitation; alternatively, an emulsion having a lower iodide content may first be precipitated and subsequently adjusted to the desired higher iodide content by the addition of KI. The following are suitable, N-heterocyclic compounds free from SH groups:

1,2,4-Triazoles:

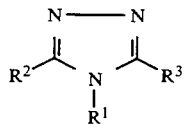

Thiadiazoles:

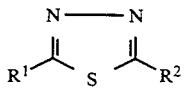

Tetrazoles:

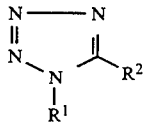

Pyrimidines:

-continued

Thiazoles:

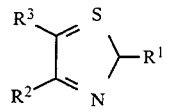

Oxadiazoles:

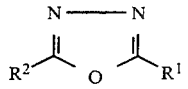

Imidazoles:

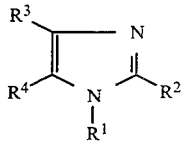

Pyridines:

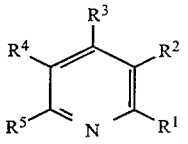

1,2,4-Triazole derivatives

| Compound | $R^1$ | $R^2$ | $R^3$ |
|---|---|---|---|
| I-1 | H | $S-CH_2-COOH$ | H |
| I-2 | $NH-CO-CH_3$ | H | H |
| I-3 | H | $SO_2-CH_2-COOH$ | H |
| I-4 | H | $NH-CH_2-COOH$ | H |
| I-5 | $NHCO-(CH_2)_2-COOH$ | $CH_3$ | $S-CH_2-COOC_2H_5$ |
| I-6 | $(CH_2)OH$ | H | H |
| I-7 | H | $S-CH(CH_3)-COOH$ | H |
| I-8 | $CH_2-CH=CH_2$ | $CH_3$ | $S-CH_2-COOH$ |
| I-9 | H | $SO_2-CH_2-CH(OH)-CH_2(OH)$ | H |
| I-10 | 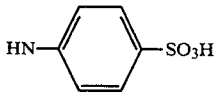 | $CH_3$ | $S-CH_2-COOC_2H_5$ |
| I-11 | H | H | H |
| I-12 | H | $NH_2$ | H |
| I-13 | $CH_2-COOH$ | H | H |
| I-14 | H | $(CH_3)_2CH$ | $S-CH_3$ |
| I-15 | H | $NH-CO-(CH_2)_2Cl$ | H |
| I-16 | H | $S-(CH_2)_2-CONH_2$ | H |

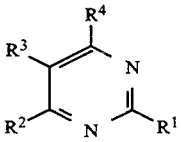

Thiadiazole derivatives

| Compound | $R^1$ | $R^2$ |
|---|---|---|
| I-17 | $NH_2$ | $S-CH_2-COOH$ |
| I-18 | $S-C_2H_5$ | $S-CH_2-COOH$ |
| I-19 | $S-CH_2-COOH$ | H |

-continued

| Compound | Thiadiazole derivatives $R^1$ | $R^2$ |
|---|---|---|
| I-20 | S—$CH_2$—COOH | S—$CH_2$—COOH |

| Compound | Tetrazole derivatives $R^1$ | $R^2$ |
|---|---|---|
| I-21 | H | NH—CO—$(CH_2)_2$Cl |
| I-22 | H | NH—CO—$CH_3$ |
| I-23 | 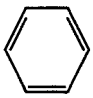 | S—$CH_2$—COOH |
| I-24 | H | NH—CO—$CH_2$Cl |
| I-25 | $C_2H_5$ | S—$CH_2$—COOH |

| Compound | Pyrimidine derivatives $R^1$ | $R^2$ | $R^3$ | $R^4$ |
|---|---|---|---|---|
| I-26 | S—$CH_2$—COOH | S—$CH_2$—COOH | H | $CH_3$ |
| I-27 | S—$CH_2$—COOH | $NH_2$ | H | OH |
| I-28 | NH—CO—$(CH_2)_2$ \| COOH | H | H | $CH_3$ |
| I-29 | S—$CH_2$—COOH | H | H | $CH_3$ |

| Compound | Thiazole derivatives $R^1$ | $R^2$ | $R^3$ |
|---|---|---|---|
| I-30 | S—$CH_2$—COOH | $CH_3$ | COOH |
| I-31 | S—$CH_2$—$COOCH_3$ | $CH_3$ | COOH |
| I-32 | $NHCOCH_3$ | H | H |
| I-33 | $CH_3$ | CH=CH—COOH | H |
| I-34 | $SCH_2$—COOH | H | H |

| Compound | $R^1$ | $R^2$ |
|---|---|---|
| I-35 | 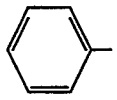 | S—$CH_2$—COOH |

| Compound | Pyridine derivative $R^1$ | $R^2$ | $R^3$ | $R^4$ | $R^5$ |
|---|---|---|---|---|---|
| I-36 | S—$CH_2$—COOH | H | H | H | H |

a)

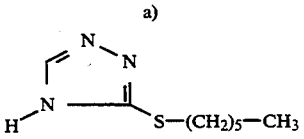

(II-1)

-continued

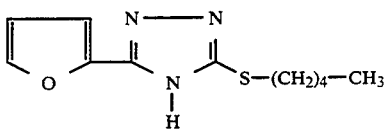

(II-2)

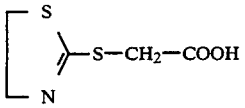

(II-3)

These compounds form silver salts which can no longer be dissolved at pH >9 by the addition of ammonia.

b)

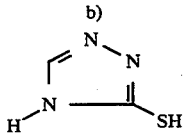

(II-4)

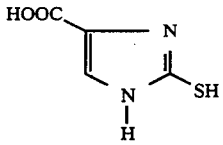

(II-5)

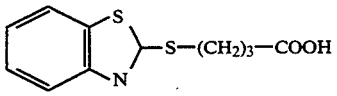

(II-6)

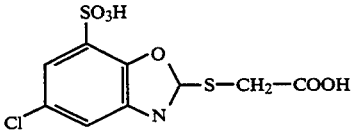

(II-7)

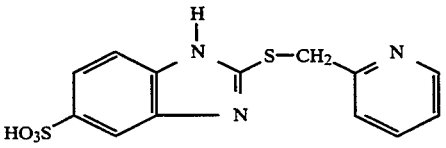

(II-8)

These compounds either contain SH groups or are not monocyclic.

In a preferred embodiment, Emulsion A is first prepared as a preliminary precipitate which may, if desired, be concentrated and desalted. The subsequent addition of substance, which according to the invention is carried out by adding Emulsion B, may be so arranged that more than 50 mol-%, preferably more than 80 mol-%, of the silver halide used is added in the form of Emulsion B. Emulsion B may also be concentrated and desalted. Emulsion B and the silver halide solvents to be used according to the invention may in principle be added simultaneously or at different times, all at once or in several portions or continuously. The concentrations of the silver halide emulsions B and A used may vary within wide limits. The quantity of silver halide solvents to be used according to the invention can generally be determined quite easily by a series of tests and in the case of imidazole and histidine is preferably from $10^{-5}$ to 2.0 mol per mol of silver halide used, in particular from $10^{-3}$ to 0.3 mol per mol of silver halide used, and in the case of the compounds other than imidazole and histidine the quantity is preferably from $10^{-6}$ to 0.5 mol per mol of silver halide used.

Emulsions for any variety of photographic materials could in principle be prepared according to the invention, e.g. negative emulsions with a high surface sensitivity, negative emulsions with a high internal sensitivity, direct positive emulsions which may be fogged or unfogged on the surface, emulsions having a layered grain structure, print-out emulsions, reverse emulsions, emulsions for black-and-white and for colour photographic materials and emulsions with a specified grain distribution and halide topography, in particular with a specified halide gradient, in particular iodide gradient.

For removal of the water-soluble salts, the silver halide emulsions prepared according to the invention and the starting emulsions A and B may either be solidified, shredded and washed in known manner or they may be coagulated with a coagulating agent and then washed, as disclosed, for example, in German Offenlegungsschrift 2 614 862. It is particularly advantageous to carry out the desalting by ultrafiltration. The emulsions prepared according to the invention and optionally also the starting emulsions, in particular Emulsion A, may be chemically sensitized, e.g. by the addition of sulphur-containing compounds at the stage of chemical ripening, for example, allylisothiocyanate, allylthiourea or sodium thiosulphate. Reducing agents may also be used as chemical sensitizers, e.g. the tin compounds described in Belgian Patent Specification 493 464 or 568 687, or polyamines such as diethylene triamine or aminomethylsulphinic acid derivatives, e.g. according to Belgian Patent Specification 547 323. Selenium compounds are also suitable.

Noble metals such as gold, platinum, palladium, iridium, ruthenium or rhodium and compounds of these metals are also suitable chemical sensitizers. This method of chemical sensitization is described in the article by R. Koslowsky, Z. Wis. Phot. 46, 65–72 (1951).

Foreign ions may be added during precipitation both to Emulsion A and to Emulsion B for the purpose of doping. This addition may also be carried out before, during or after the process of Ostwald ripening. Suitable compounds are, for example, iridium and rhodium compounds.

Both Emulsion A and Emulsion B may be subjected to a reduction ripening during precipitation. Such sensitization by reduction may also be carried out before, during and after the process of Ostwald ripening.

This measure and suitable compounds are described e.g. in EP 348 934, 368 304, 369 424, 371 338, 369 491, 378 841, 404 142, 435 270 and 435 355 and U.S. Pat. No. 4 917 997.

It may also be advantageous to carry out an oxidation either during subsequent stages of precipitation or before chemical sensitization. Suitable compounds for this purpose are, for example, thiosulphonic acid derivatives, $H_2O_2$ and mercury-(II) compounds.

The emulsions may also be sensitized with polyalkylene oxide derivatives, e.g. polyethylene oxide having a molecular weight of from 1000 to 20,000 or condensation products of alkylene oxides and aliphatic alcohols, glycols or cyclic dehydration products of hexitols or alkyl substituted phenols, aliphatic carboxylic acids or aliphatic amines, aliphatic diamines and amides. The condensation products have a molecular weight of at least 700, preferably more than 1000. These sensitizers may, of course, be combined for producing special effects, as described in Belgian Patent Specification 536 278 and in British Patent Specification 727 982.

The emulsions may also be optically sensitized, e.g. with the usual polymethine dyes such as neutrocyanines, basic or acid carbocyanines, rhodacyanines, hemicyanines, styryl dyes, oxonoles and the like. Sensitizers of this type are described in F.M. Hamer: "The Cyanine Dyes and related Compounds" 1964, Interscience publishers, John Wiley and Sons..

The emulsions may contain the usual stabilizers, e.g. homopolar or salt type compounds of mercury containing aromatic or heterocyclic rings, such as mercaptotriazoles, simple mercury salts, sulphonium mercury double salts and other mercury compounds. Azaindenes are also suitable stabilizers, particularly tetra- or pentaazaindenes, especially those which are substituted with hydroxyl or amino groups. Compounds of this type are described in Birr: Z. Wiss. Phot. 47 (1952), 2–58. Other suitable stabilizers include inter alia heterocyclic mercapto compounds, e.g. phenylmercapto compounds, quaternary benzothiazole derivatives and benzotriazole.

According to the invention, it is of advantage to use gelatine as binder or protective colloid for the photographic emulsions according to the invention but other colloids may also be used; :for example, various synthetic hydrophilic materials of high molecular weight such as graft polymers of gelatine and other materials having a high molecular weight; proteins such as albumin, casein and the like; cellulose derivatives such as hydroxyethyl cellulose, carboxymethyl cellulose, cellulose sulphate and the like; saccharide derivitives such as sodium alginate, starch derivatives and the like; homopolymers or copolymers such as polyvinyl alcohol, partially acetalised polyvinyl alcohol, poly-N-vinylpyrrolidone, polyacrylic acid, polymethacrylic acid, polyacrylamide, polvinyl imidazole and polyvinyl pyrazole.

Suitable gelatine graff: polymers for use according to the invention are those obtained by grafting homopolymers or copolymers of vinyl monomers such as acrylic acid, meth-acrylic acid or derivatives thereof, e.g. their esters, amides, acrylonitrile or styrene, on gelatine. Graft polymers of gelatine with polymers of acrylic acid, methacrylic acid, acrylamide, methacrylamide or hydroxy-alkylmethacrylates are particularly preferred..

The emulsions may be hardened in the usual manner, for example with formaldehyde or halogen-substituted aldehydes containing a carboxyl group, such as mucobromic acid, diketones, methane sulphonic acid esters and dialdehydes.

The photographic layers may also be hardened with epoxide type hardeners or hardeners of the type of heterocyclic ethyleneimine or acryloyl. Examples of such hardeners are described, for example, in German Offenlegungsschrift 2 263 602 or in British Patent Specification 1 266 655. The layers may also be hardened by the process according to German Offenlegungsschrift 2 218 009 for obtaining colour photographic materials which are suitable for high temperature processing.

The photographic layers or colour photographic multilayered materials may also be hardened with hardeners of the diazine, triazine or 1,2-dihydroquinoline series as described in British Patent Specifications 1 193 290, 1 251 091, 1 306 544 and 1 266 655, French Patent Specification 71 02 716 or German Offenlegungsschrift 2 332 317. Examples of such hardeners include diazine derivatives containing alkyl or aryl sulphonyl groups, derivatives of hydrogenated diazines or triazines such as 1,3,5-hexahydrotriazine, fluoro-substituted diazine derivatives, e.g. fluoropyrimidine, and esters of 2-substituted 1,2-dihydroquinoline- or 1,2-dihydroisoquinoline-N-carboxylic acid. Vinyl sulphonic acid hardeners and carbodiimide or carbamoyl hardeners as described e.g. in German Offenlegungsschriften 2 263 602, 2 225 230 and 1 808 685, French Patent Specification 1 491 807, German Patent Specification 872 153 and DD-A-7218 are also suitable. Other suitable hardeners are described, for example, in British Patent Specification 1 268 550.

The present invention may be employed both for the preparation of black-and-white photographic images and for colour photographic images. Coloured photographic images may be produced, for example, according to the known principle of chromogenic development in the presence of colour couplers which react with the oxidation product of colour producing p-phenylenediamine developers to form dyes.

The colour couplers :may be added, for example, to the colour developer on the principle of the so-called incorporation development process. In a preferred embodiment, the photographic material itself contains the usual colour couplers, which are generally incorporated in the silver halide layers. Thus the red-sensitive layer, for example, may contain a non-diffusible colour coupler for producing the cyan partial colour image, generally a coupler of the phenol or α-naphthol series. The green-sensitive layer :may,, for example, contain at least one non-diffusible colour coupler for producing the magenta partial colour image, colour couplers of the 5-pyrazolone, the indazc, lone or the pyrazoloazole series being usually employed for this purpose. The blue-sensitive layer may, for example, contain a non-diffusible colour coupler for producing the yellow partial colour image, generally a colour coupler containing an open chain ketomethylene group. Numerous colour couplers of this type are known and have been described in many Patent Specifications. For example, reference may be had to the publication entitled "Farbkuppler" by W. Pelz in "Mitteilungen aus den Forschungslaboratorien der Agfa, Leverkusen/Mtinchen", Volume III (1961 ) and to K. Venkataraman in "The Chemistry of Synthetic Dyes", Volume 4, 341–387, Academic Press, 1971.

2-Equivalent couplers may also be used as non-diffusible colour couplers; these contain a removable substituent in the coupling position so that, in contrast to the usual 4-equivalent couplers, these couplers require only two equivalents of silver halide for producing the colour. Suitable 2-equivalent couplers include, for example, the known DIR couplers, in which the removable group is released as a diffusible development inhibitor after the reaction with colour developer oxidation products. So-called white couplers, which give rise to a colourless coupling product, may also be used for improving the properties of the photographic material.

The non-diffusible colour couplers and colour producing compounds are added to the light-sensitive silver halide emulsions or other casting solutions by the usual known methods. If these compounds are water-soluble or alkali-soluble, they may be added to the emulsions in the form of aqueous solutions, optionally with the addition of water-miscible organic solvents such as ethanol, acetone or dimethylformamide. If the non-diffusible colour couplers and colour producing compounds are insoluble in water or alkalies, they may be emulsified in known manner, e.g. by mixing a solution of these compounds in a low boiling organic solvent directly with the silver halide emulsion or first with an aqueous gelatine solution and then removing the organic solvent in the usual manner. The resulting gelatine emulsion of the given compound is then mixed with the silver halide emulsion. The emulsification of such hydrophobic compounds may be assisted by means of so-called coupler solvents or oil formers, which are generally relatively high boiling organic compounds in which the nondiffusible colour couplers and development inhibitor-releasing compounds which are to be emulsified in the silver halide emulsions become enclosed in the form of oily droplets. See in this connection, for example, U.S. Pat. No. 2 322 027, 2 533 514, 3 689 271, 3 764 336 and 3 765 897. The emulsions prepared according to the invention may be applied to the usual layer supports, e.g. supports of cellulose esters such as cellulose acetate or cellulose acetobutyrate or polyesters, in particular polyethylene terephthalate, or polycarbonates, in particular those based on bis-phenylolpropane. Pager supports are also suitable; these may contain water-impermeable polyolefin layers, e.g. of polyethylene or polypropylene. Glass or metal supports may also be used.

Emulsion B used in the following Examples is a silver bromide emulsion having an average grain size of 0.05 μm and containing 1.25 mol of silver halide per kg and 18 g of gelatine per kg.

Example 1

AgBrI emulsion A1 is prepared-by a double jet process and contains 1 mol of silver halide and 32 g of gelatine per kg. The average grain size is 0.4 μm and the iodide content is 25 mol-%.

3000 g of Emulsion B are mixed with 1500 g of Emulsion A1 and the mixture is digested at 65° C., pH 7.5 and an $E_{Ag}$ value of −60 mV in the presence of the substances shown in Table 1 until Ostwald ripening has been completed (after about 20 minutes). The product is then coagulated, washed and finally redispersed with the addition of water and gelatine. Optimum ripening with gold and sulphur compounds is then carried out. The average grain size is 0.7 μm and the iodide content 7 mol-%.

Example 2

AgBrI emulsion A2 is prepared by a double jet process and contains 1 mol of silver halide and 32 g of gelatine per kg. The average grain size is 0.7 μm and the iodide content is 40 mol-%.

9000 g of Emulsion B are mixed with 1500 g of Emulsion A2 and the mixture is digested at 60° C., pH 7.5 and an $E_{Ag}$-value of −60 mV in the presence of the substances shown in Table 2 until Ostwald ripening has been completed (after about 20 minutes). Further processing is the same as in Example 1. The average grain size is 1.1 μm and the iodide content is 4.7 mol-%.

Example 3

AgBrI emulsion A3 is prepared by a double jet process and contains 1 mol of silver halide and 32 g of gelatine per kg. The average grain size is 0.5 μm and the iodide content is 70 mol-%; precipitation is first carried out with an iodide content of 30 mol-% and this is then converted to the given iodide content by the addition of KI.

5800 g of Emulsion B are mixed with 1500 g of Emulsion A3 and the mixture is digested at 70° C., pH 7.5 and an $E_{Ag}$-value of −60 mV in the presence of the substances shown in Table 3 until Ostwald ripening has been completed, which takes about 20 minutes. Further processing is carried out as in Example 1.

The average grain size is 1.1 μm and the iodide content is 12 mol-%.

TABLE 1

| | 1st Compound | Quantity (mol/mol Ag) | 2nd Compound | Quantity mol/mol Ag) | E | S |
|---|---|---|---|---|---|---|
| 1.1 | Imidazole | 0.07 | — | — | 100 | 21 |
| 1.2 | Histidine | 0.20 | — | — | 90 | 19 |
| 1.3 | Imidazole | 0.07 | I-1 | $5.10^{-4}$ | 165 | 18 |
| 1.4 | Imidazole | 0.07 | I-7 | $5.10^{-4}$ | 141 | 16 |
| 1.5 | Imidazole | 0.07 | I-10 | $5.10^{-4}$ | 152 | 19 |
| 1.6 | Imidazole | 0.07 | I-20 | $5.10^{-4}$ | 175 | 22 |
| 1.7 | Histidine | 0.20 | I-9 | $5.10^{-4}$ | 155 | 20 |
| 1.8 | Histidine | 0.20 | I-18 | $5.10^{-4}$ | 180 | 18 |
| 1.9 | Histidine | 0.20 | I-23 | $5.10^{-4}$ | 151 | 21 |
| 1.10 | Histidine | 0.20 | I-29 | $5.10^{-4}$ | 169 | 19 |
| 1.11 | Histidine | 0.20 | I-31 | $5.10^{-4}$ | 173 | 17 |
| 1.12 | Histidine | 0.20 | II-1 | $5.10^{-4}$ | 42 | 15 |
| 1.13 | Imidazole | 0.07 | II-7 | $5.10^{-4}$ | 51 | 18 |

E: Relative sensitivity, doubling of the given value corresponding to doubling of the sensitivity.
S: Fog
Examples 1.3 to 1.11 are examples according to the invention which have an improved sensitivity/grain size ratio.

TABLE 2

| | 1st Compound | Quantity (mol/mol Ag) | 2nd Compound | Quantity (mol/mol Ag) | E | S |
|---|---|---|---|---|---|---|
| 1.1 | Imidazole | 0.12 | — | — | 100 | 19 |
| 2.2 | Histidine | 0.40 | — | — | 78 | 18 |
| 2.3 | Imidazole | 0.12 | I-2 | $10^{-2}$ | 155 | 21 |
| 2.4 | Imidazole | 0.12 | I-4 | $10^{-2}$ | 172 | 20 |
| 2.5 | Imidazole | 0.12 | I-35 | $10^{-2}$ | 178 | 19 |
| 2.6 | Imidazole | 0.12 | I-36 | $10^{-2}$ | 169 | 20 |
| 2.7 | Histidine | 0.40 | I-9 | $10^{-2}$ | 158 | 21 |
| 2.8 | Histidine | 0.40 | I-11 | $10^{-2}$ | 153 | 20 |
| 2.9 | Histidine | 0.40 | I-25 | $10^{-2}$ | 165 | 18 |
| 2.10 | Histidine | 0.40 | I-33 | $10^{-2}$ | 174 | 19 |
| 2.11 | Histidine | 0.40 | II-3 | $10^{-2}$ | 48 | 21 |
| 2.12 | Imidazole | 0.12 | II-8 | $10^{-2}$ | 39 | 19 |

Examples 2.3 to 2.10 are Examples according to the invention which have an improved sensitivity/grain size ratio.

TABLE 3

| | 1st Compound | Quantity (mol/mol Ag) | 2nd Compound | Quantity (mol/mol Ag) | E | S |
|---|---|---|---|---|---|---|
| 3.1 | Imidazole | 0.08 | — | — | 100 | 21 |
| 3.2 | Histidine | 0.30 | — | — | 103 | 22 |
| 3.3 | Imidazole | 0.08 | I-5 | $3.10^{-3}$ | 174 | 20 |
| 3.4 | Imidazole | 0.08 | I-16 | $3.10^{-3}$ | 162 | 19 |
| 3.5 | Imidazole | 0.08 | I-21 | $3.10^{-3}$ | 181 | 20 |
| 3.6 | Imidazole | 0.08 | I-22 | $3.10^{-3}$ | 175 | 19 |
| 3.7 | Imidazole | 0.08 | I-32 | $3.10^{-3}$ | 168 | 18 |
| 3.8 | Imidazole | 0.08 | I-35 | $3.10^{-3}$ | 152 | 19 |
| 3.9 | Histidine | 0.30 | I-1 | $3.10^{-3}$ | 163 | 20 |
| 3.10 | Histidine | 0.30 | I-4 | $3.10^{-3}$ | 166 | 21 |
| 3.11 | Histidine | 0.30 | I-12 | $3.10^{-3}$ | 149 | 19 |
| 3.12 | Histidine | 0.30 | I-26 | $3.10^{-3}$ | 170 | 22 |
| 3.13 | Histidine | 0.30 | I-28 | $3.10^{-3}$ | 174 | 21 |
| 3.14 | Histidine | 0.30 | II-4 | $3.10^{-3}$ | 61 | 18 |
| 3.15 | Imidazole | 0.08 | II-5 | $3.10^{-3}$ | 55 | 19 |
| 3.16 | Imidazole | 0.08 | II-6 | $3.10^{-3}$ | 43 | 18 |

Examples 3.3 to 3.13 are examples according to the invention which have an improved sensitivity/grain size ratio.

Example 4

Both the emulsions prepared according to 1.1 and those prepared according to 1.3 are subjected not only to optimum gold-sulphur ripening but also to an optimum ripening in which selenium compounds are present as well as gold and sulphur compounds. Suitable selenium compounds for this purpose are described, for example, in EP 428 041,458 278 and 476 345.

| Emulsion | Ripening | E | S |
|---|---|---|---|
| 1.1 | S/Au | 100 | 21 |
| 1.1a | S/Se/Au | 104 | 28 |
| 1.3 | S/Au | 165 | 18 |
| 1.3a | S/Se/Au | 208 | 26 |

In Example 1.3 according to the invention, the addition of selenium for ripening causes a substantially greater increase in sensitivity than in Example 1.1 which is not according to the invention.

We claim:

1. A process for the preparation of a silver halide emulsion containing up to 20 mol-% of AgI by the precipitation of a silver halide emulsion A containing up to 100 mol-% of AgI and the addition of a silver halide emulsion B which contains up to 40 mol-% of AgI, has an average grain size of at most 0.25 μm, and is always more soluble in aqueous gelatine solution than Emulsion A either due to its grain size or due to its iodide content, in the presence of at least two compounds from the series imidazole, histidine (α-amino-β-imidazolyl-(5)-propionic acid) and other monocyclic 5- or 6-membered heterocyclic compounds which have at least one ring nitrogen atom and are free from SH groups and form sparingly soluble silver salts in weak acid to neutral aqueous solution, which salts redissolve at pH>9 when ammonia is added, one of the at least two compounds being imidazole or histidine and at least one other compound being a compound other than imidazole or histidine.

2. A process according to claim 1, characterised in that the iodide content of Emulsion A is from 10 to 90 mol-%.

3. A process according to claim 1, characterised in that Ostwald ripening takes place at $E_{Ag}$ from −20 to −120 mV, pH 4 to 10 and a temperature from 40 to 90° C.

4. A process according to claim 3, characterised in that the ratio by weight of gelatine/silver halide expressed as quantity of silver nitrate used is from 0.05 to 1 at the stage of Ostwald ripening.

5. A process according to claim 4, characterised in that the ratio by weight of gelatine/silver halide expressed as quantity of silver nitrate used is from 0.1 to 0.5 at the stage of Ostwald ripening.

6. A process according to claim 3, characterised in that Emulsions A and B are used for the Ostwald ripening in a ratio by weight of from 1:1 to 1:20, expressed as quantities of silver nitrate used.

7. A process according to claim 6, characterised in that Emulsions A and B are used for the Ostwald ripening in a ratio by weight of from 1:2 to 1:10, expressed as quantifies of silver nitrate used.

8. A process according to claim 1, characterised in that Ostwald ripening takes place at $E_{Ag}$ of from −40 to −100 mV, pH 6 to 8 and a temperature from 50 to 75° C.

9. A process according to claim 1, characterised in that the monocyclic heterocyclic compounds which differ from imidazole and histidine, are free from SH groups and have at least one ring nitrogen atom and form sparingly soluble salts in weak acid to neutral aqueous solutions, which salts redissolve in ammoniacal solution at pH>9 when ammonia is added, belong to the following classes of compounds: Imidazoles, oxazoles, thiazoles, triazoles, thiadiazoles, oxadiazoles, pyridines, tetrazoles and pyrimidines.

10. A process according to claim 1, characterised in that imidazole and/or histidine is or are used in a quantity of from 104 to 2.0 mol/mol of silver halide and the compounds other than imidazole and histidine are used in a quantity of from $10^{-6}$ to 0.5 mol/mol of silver halide.

11. The process according to claim 10, wherein the imidazole and/or histidine is or are used in the quantity of from $10^{-3}$ to 0.3 mol/mol of silver halide.

12. A process according to claim 1, wherein the compounds are selected from the group consisting of imidazoles, histidines, oxazoles, thiazoles, triazoles, thiadiazoles, oxadiazoles, pyridines, tetrazoles and pryimidines which may be unsubstituted or substituted by alkyl, alkenyl, aryl, halogen, carboxylic acid groups, sulphonic acid groups, thioether or amino groups.

13. A process according to claim 12, wherein the alkyl group contains up to four carbon atoms, the aryl group is phenyl, the halogen is chlorine or bromine, the carboxylic acid group is carbalkoxy or carbonamido, the thioether is methylthio or carboxyalkylthio and the sulphonic acid groups are sulphonamide or sulphones.

14. The process according to claim 1, wherein emulsions A and B are mainly silver iodobromide emulsions.

15. The process according to claim 14, wherein emulsion A has a grain size ranging from 0.1 to 1.5 μm and the grain size of emulsion B ranges from 0.01 to 0.2 μm.

16. The process according to claim 14, where the iodine content of emulsion A is from 40 to 90 mol %, the emulsion A consists predominately of grains containing about 40 mol of AgI and pure AgI grains.

17. The process according to claim 1, wherein emulsion A is first prepared as a preliminary precipitate which may optionally be concentrated and desalted and then adding emulsion B such that more than 50% of the silver halide is used is added in the form of emulsion B.

18. The process according to claim 17, wherein more than 80% of the silver halide is used is added in the form of emulsion B.

19. The process according to claim 1, wherein emulsions A and/or B contain stabilizers.

20. The process of applying the silver halide emulsion according to claim 1 to a layer support.

* * * * *